United States Patent [19]

Duffy

[11] Patent Number: 4,903,847

[45] Date of Patent: Feb. 27, 1990

[54] LIBRARY SHELF ASSEMBLY

[76] Inventor: James C. Duffy, 9300 Dillon Dr., La Mesa, Calif. 92041

[21] Appl. No.: 247,635

[22] Filed: Sep. 22, 1988

[51] Int. Cl.[4] ..... A47F 43/00

[52] U.S. Cl. ..... 211/187; 211/208

[58] Field of Search ..... 211/187, 186, 190, 191, 211/192, 208; 108/144, 111, 106, 107

[56] References Cited

U.S. PATENT DOCUMENTS

| | | | |
|---|---|---|---|
| 972,447 | 10/1910 | Harper | 211/208 X |
| 1,282,557 | 10/1918 | Feldtkeller | 211/208 X |
| 3,325,017 | 6/1967 | Tucker | 211/187 X |
| 3,655,159 | 4/1972 | Held, Jr. | 211/187 X |
| 3,814,034 | 6/1974 | Seiz | 211/187 X |
| 4,013,362 | 3/1977 | Beckman, Jr. | 355/75 |
| 4,312,452 | 1/1982 | Waier | 211/208 X |
| 4,342,397 | 8/1982 | Halstrick | 211/191 |
| 4,379,430 | 4/1983 | Ruschitzka | 211/190 X |
| 4,516,612 | 5/1985 | Wiley | 144/134 R X |
| 4,537,316 | 8/1985 | Simon et al. | 211/187 X |
| 4,553,626 | 11/1985 | Kazmierczak et al. | 74/482 X |

*Primary Examiner*—Alvin C. Chin-Shue
*Assistant Examiner*—Sarah A. Lechok
*Attorney, Agent, or Firm*—Charles C. Logan, II

[57] ABSTRACT

A library shelf assembly that has been designed to meet seismic code requirements for libraries in the state of California. The novel library shelf assembly has a tubular base support having a pair of right angularly shaped gussets welded to its top surface. The gussets have vertical edges that are spaced from each other a distance equal to the width of the post assembly that is received therebetween. A plurality of pairs of hat-shaped straps have their opposite ends bolted together thereby capturing the post assembly between the respective gussets. Anchor plates are welded on the opposite ends of the tubular base support for securing the base supports to a concrete or other type of floor structure. Conventional shelf brackets have their fingers detachably received in vertically oriented rows of spaced slots in the respective post assemblies. Standard shelves are connected between the respective shelf brackets.

2 Claims, 1 Drawing Sheet

LIBRARY SHELF ASSEMBLY

BACKGROUND OF THE INVENTION

The invention relates to a book shelf and more specifically to a library shelf assembly. One of the problems existing in California schools is all library shelving installed must meet the seismic code requirements for Zone 4. The concern is great due to the possibility of students and personnel being injured during earth quake tremors that result in library shelves falling over. The seismic code requires the library shelf assembly must be capable of withstanding a horizontal force in any direction equal to thirty percent of the weight of all of the books in the shelves, plus the weight of the shelving.

Older existing library shelves that do not meet the seismic code must be upgraded to meet the new standard. Some of the existing library shelf assemblies cannot be sufficiently modified to meet the seismic code and need to be replaced. Funding has delayed upgrading of the library shelf assemblies. Only recently due to public exposure of the danger that exists in the state schools has some funding made available.

Each library has shelving made by many different manufacturers, some of which cannot be economically upgraded and must be replaced. One of the types of shelving made by Ames can be modified at a cost below the replacement cost and is identified as Contemporary Ames and its structure is illustrated in the Held Jr., U.S. Pat. No. 3,655,159. The structure of applicant's modification kit can be utilized with the Ames shelving to bring it up to code standard.

SUMMARY OF THE INVENTION

Applicant's novel structure for library shelf assemblies has been designed to meet the seismic code requirements for Zone 4 in California. This means they will withstand a horizontal force in any direction equal to thirty percent of the weight of all books in the shelves plus the weight of the shelving itself.

Applicant's novel structure may be used to retrofit existing Ames shelving or it could be utilized in new library shelving having post assemblies similar to that of Ames library shelf assemblies. The distinctive structure that is involved begins with a square mild steel tubing base support that has a predetermined number of slots cut on opposite sides of this tubing in the area adjacent the middle of its length for accepting the bottom end of existing post assemblies. A mild steel plate is welded to the bottom of the tubular base support at its midpoint to provide partial support for the post. A mild steel anchor plate is welded to the bottom of the tubular base support at each of its ends. These anchor plates have a hole in them which permits bolting the base support to the floor. These bolts in the floor prevent the range from tipping over in a transverse direction.

Two mild steel right angularly shaped gussets have their bottom horizontal edges welded to the top surface of the square tubular base support. A predetermined gap is maintained between the vertical edges of the respective gussets to permit the existing post assembly to slip between the gussets into the slots in the mid point of the tubular base support. The gussets or braces are secured to the slotted sides of the post by three pairs of mild steel formed strap assemblies. These strap assemblies are each formed of a pair of hat-shaped straps that have bolts passing through each pair and the respective gussets to firmly secure them to the post assemblies.

The brace assemblies position the gussets midway between the front and back side of the post assemblies and this allows the shelf brackets to be inserted into the double row spaced slots on each side of the post assembly without interference. The strap assemblies are positioned at predetermined heights on the post assembly and the lowest strap assembly has a hole in its center that matches with an existing hole in the post assembly through which a bolt is inserted to secure the post assembly to the tubular base support.

The proceedure for installing applicant's novel structure on an existing range formed of connected Ames library shelf assemblies is quite simple. All books, shelves and brackets are removed from the posts of a range to be modified. One end of the range is lifted so as to place a wood block under one of its end base supports. Next the other end of the range is lifted and a second block placed under this base support. The unsupported base supports are then removed from the posts by loosening the bolt on the under side of the post and then driving the base support down and off the post by using a mallet. A new modification kit can now be installed on the post. This is done by removing the strap assemblies and then sliding the combined structure of the tubular base support and the gussets under of the center of the range and then rotating its top upwardly so the gussets straddle the lower tie beam. When the kit is in its vertical position it can be positioned under the post and then raised so that the slots of the tubular base support slip over the end of the post. Once the kit is in its upward position, the three pairs of strap assemblies can be installed along with the bolt that is inserted through the lowest pair of strap assemblies to tie the kit structure to the post. Next the blocks are moved inwardly under the new tubular base supports so that the end tubular base supports can also be replaced with the new modification kits. Next the remaining blocks can be removed and the library shelf range assembly can be moved to its desired location. Holes would then be drilled in the concrete at each end of the new base support and bolts would be inserted and tightened down. Then the shelf brackets, shelves and books are remounted on the library shelf assembly.

DESCRIPTION OF THE PREFERRED EMBODIMENT

Figure 4:
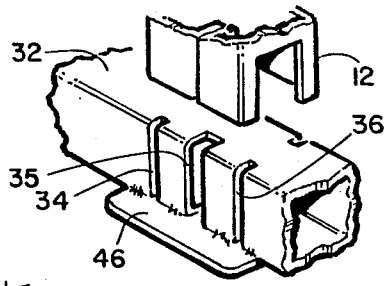
FIG. 4 is a partial perspective view illustrating how the bottom of the post assembly attaches to the base support.
Figure 3:
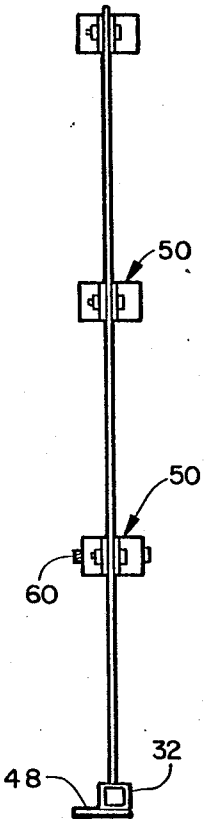
FIG. 3 is a side elevation view of the kit assembly.
Figure 2:
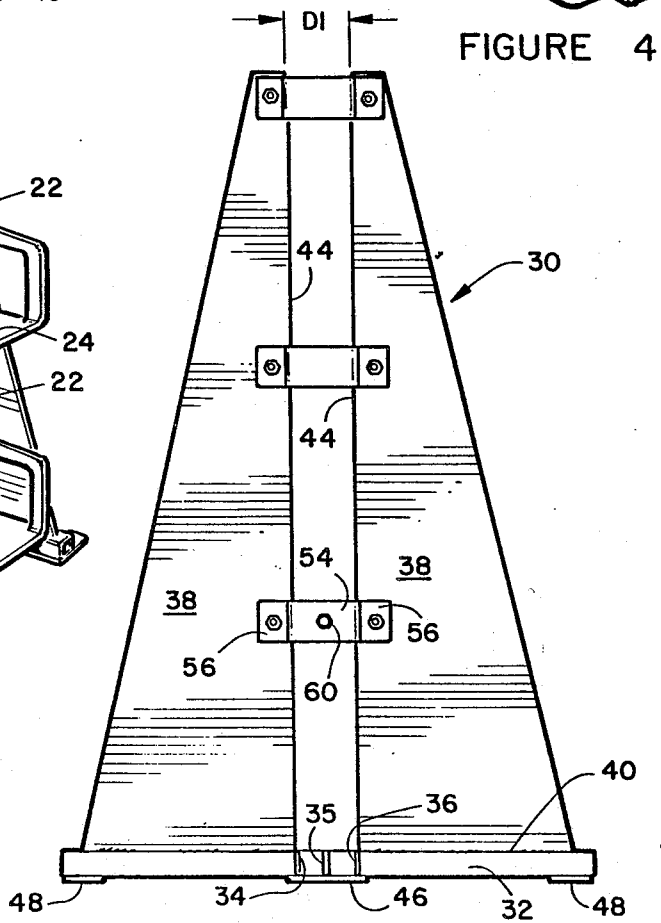
FIG. 2 is an end elevation view of the kit assembly that is structurally attached to the post assembly.
Figure 1:
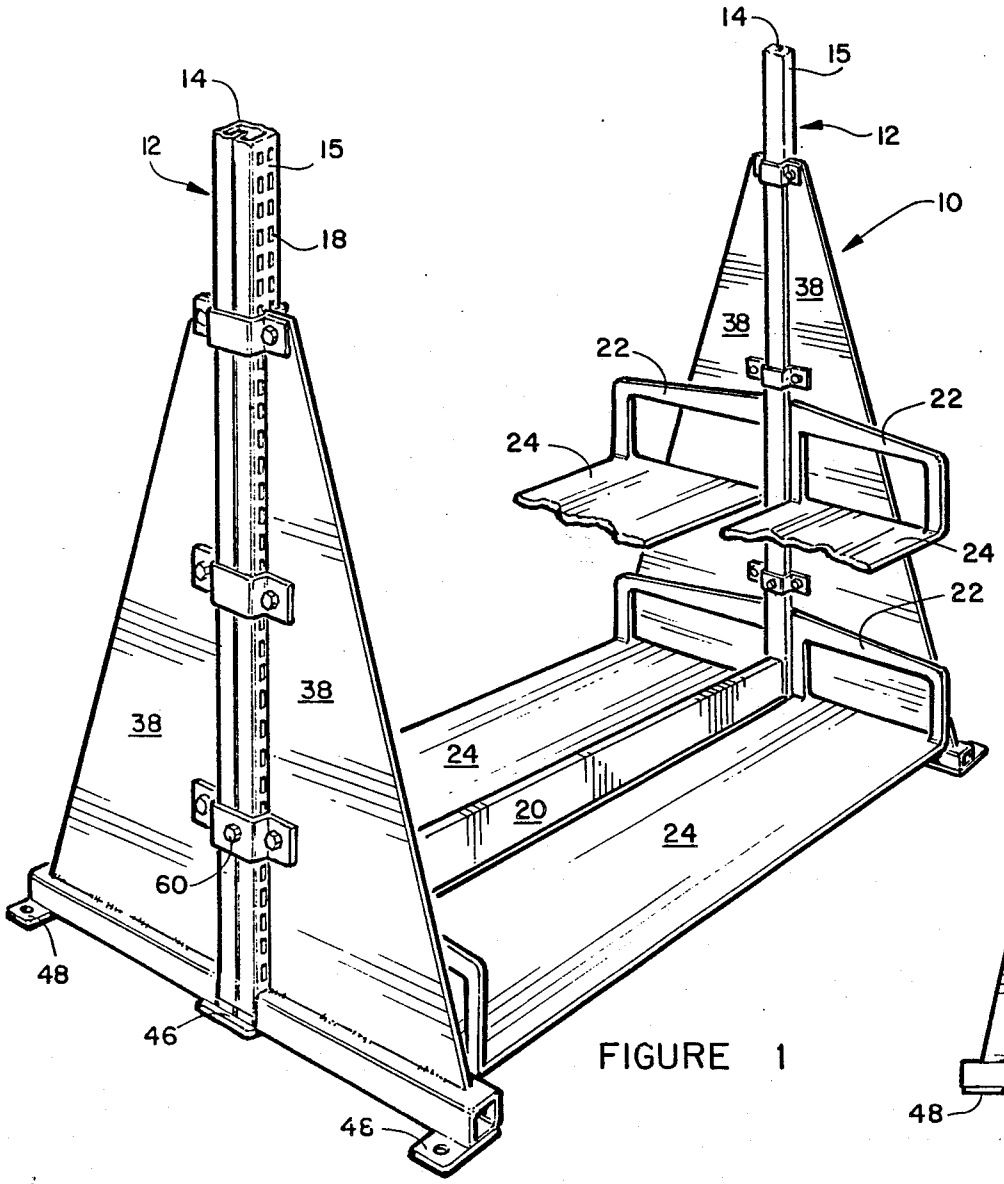
FIG. 1 is a partial perspective view of a library shelf assembly illustrating applicant's novel structure secured to the existing post assembly.

Applicant's novel library shelf assembly and the kit that may be installed on certain existing library shelf range assemblies will now be described by referring to FIGS. 1–3 of the drawing. The library shelf assembly is generally designated numeral 10. It has a post assembly 12 formed from one piece of sheetmetal and it has double rows of spaced slots 18 on its opposite sides. The post assembly 12 has a rear wall 14, side walls 15 and 16, a front wall left side panel 17, and a front wall right side panel 19. It also has inwardly extending flanges 21 and 22 that are connected to the respective front wall right and left side panels. The bottom ends of post assemblies 12 have slots 13 formed in the respective side walls 15 and 16. A tie beam 20 has its opposite ends secured to the bottom ends of post assemblies 12. A similar tie beam secures the top ends of the post assemblies together. Shelf brackets 22 have their fingers 23 inserted into the respective slots 18. Shelves 24 extend between the respective shelf brackets 22.

The modification kit assembly 30 that is attached to the respective post assemblies 12 will now be described by referring to FIG. 2. It has a square tubular base support 32 having slots 34, 35, and 36 formed in its front walls 37 and a portion of its top wall. Gussets or braces 38 each have a horizontal bottom edge 40 that is welded to the top surface of tubular base support 32. The vertical edges 44 are laterally spaced from each other a predetermined distance D1 which is substantially equal to the width of the post assemblies 12.

A steel reinforcing plate 46 is welded to the bottom surface of tubular base support 32. Also anchor plates 48 are welded to the bottom surface of tubular base support 32 at its opposite ends. These anchor plates have a bolt aperture therein for bolting the kit assembly to the floor surface.

Strap assemblies 50 are formed from a pair of hat-shaped brackets 52 having a U-shaped central portion 54 and leg portions 56. Bolt apertures are formed in the strap members and bolts 60 pass therethrough and secure the respective brace assemblies to each other and the gussets 38 while at the same time capturing the post assembly therebetween. The lower most brace assembly has apertures through which a bolt 60 is inserted that also passes through an aperture in the post assembly 12 for securing the two together.

What is claimed is:

1. A library shelf assembly comprising:

at least two vertically oriented post assemblies laterally spaced apart a predetermined distance, said post assemblies being integrally formed from a single piece of sheet metal that has been bent into a configuration having a rear wall, laterally spaced side walls, a front wall left side panel, a front wall right side panel, and said respective front wall panels each having an inwardly extending flange, each of said post assemblies having a predetermined width D1 as measured from the outside surfaces of its respective side walls, said post assemblies each having a top end and a bottom end, said bottom ends having a slot formed in each of the side walls of said post assemblies for mating with slots formed in horizontally oriented tubular base support members, said post assemblies having vertically oriented double rows of spaced slots on its respective side walls for receiving mating fingers from shelf brackets;

an elongated tie beam having its opposite ends secured to said respective post assemblies adjacent their bottom ends;

a plurality of elongated shelves each having a shelf bracket attached to its respective ends, said shelf brackets having fingers extending from them that are removably received in said vertically spaced slots in the respective side walls of said post assemblies;

a pair of post assembly reinforcing units each of which comprises a transversely extending elongated horizontally oriented tubular base support having a top surface, a front wall, a rear wall and a bottom surface, a pair of vertically oriented gussets each having a vertical edge and a horizontal edge, each of said gussets being formed of a sheet of mild steel and each having a right angularly shaped configuration, the vertical edges of said respective gussets being laterally spaced apart a distance substantially equal to the width D1 of said post assemblies which is received therebetween, the horizontal edges of said gussets being welded to the top surface of said tubular base support, and means for securely holding each of said respective post assemblies between the vertical edges of said respective gussets; and said means for securely holding each of said respective post assemblies between the vertical edges of said gussets comprising a plurality of strap assemblies each having a pair of hat-shaped brackets that are secured to each other by bolts passing through them and said respective gussets.

2. A library shelf assembly as recited in claim 1 further comprising means for securing said tubular base supports to a floor surface.

* * * * *